United States Patent [19]

Konnerth, III

[11] 4,050,628

[45] Sept. 27, 1977

[54] HEAT RECLAIMER

[76] Inventor: Andrew Konnerth, III, 9 Little Harbor Road, Woods Hole, Mass. 02543

[21] Appl. No.: 763,324

[22] Filed: Jan. 28, 1977

[51] Int. Cl.[2] ..... F24B 7/04

[52] U.S. Cl. ..... 237/55; 126/110 R; 126/102; 236/16; 126/312; 126/307 A; 165/DIG. 2; 98/48

[58] Field of Search ..... 165/DIG. 2, 102, 103, 165/128; 237/55; 126/110 R, 102, 117, 122, 312, 307 A; 98/45, 46, 48; 236/16

[56] References Cited

U.S. PATENT DOCUMENTS

| | | | |
|---|---|---|---|
| 442,846 | 12/1890 | Whiting | 165/103 |
| 762,203 | 6/1904 | Segerstrom | 165/128 |
| 1,160,954 | 11/1915 | Parker | 98/48 |
| 2,343,542 | 3/1944 | Faunce | 165/103 |
| 2,764,391 | 9/1956 | Pullen | 165/DIG. 2 |
| 3,124,197 | 3/1964 | Funk | 237/55 |

*Primary Examiner*—John J. Camby
*Assistant Examiner*—Henry C. Yuen
*Attorney, Agent, or Firm*—Thompson, Birch, Gauthier & Samuels

[57] ABSTRACT

An apparatus for reclaiming heat from and for controlling the flow of combustion gases passing through a flue from a heater to an exhaust stack. The apparatus includes an inner housing having first inlet and outlet openings. The first inlet opening is adapted for connection by one section of the flue to the heater, whereby combustion gases from the heater will enter the inner housing through the first inlet opening and will exit therefrom through the first outlet opening. An outer housing at least partially surrounds the inner housing, the said inner and outer housings being spaced one from the other to define an intermediate chamber which is in communication with the inner housing's first outlet opening. The outer housing is provided with a second outlet opening which is aligned with the first outlet opening and in communication with an integral damper housing which is in turn adapted for connection by another flue section to the exhaust stack. The inner housing contains mutually spaced heat transfer conduits through which a flow of ambient air is directed to reclaim heat from the combustion gases exiting from the heater. A damper in the damper housing is adjustable between an open position allowing combustion gases flowing from the inner housing to pass through the other flue section to the exhaust stack, and a closed position retarding the flow of gases therethrough. When the apparatus is employed in conjunction with a gas heater, the outer housing is preferably additionally provided with a second inlet opening open to the ambient air, thereby allowing the intermediate chamber to function as a draft diverter.

4 Claims, 4 Drawing Figures

HEAT RECLAIMER

DESCRIPTION OF THE INVENTION

This invention relates generally to heat devices, and is concerned in particular with a heat reclaimer adapted for installation in the flue connecting a heater, such as for example a gas or oil fired home heating unit, to an exhaust stack or chimney.

A general object of the present invention is to provide a heat reclaimer which is combined in a single integral unit with a motorized damper to thereby provide a compact economical unit which can be located conveniently between a heater and an exhaust stack.

Another object of the present invention is the provision of a heat reclaimer contained in an inner housing surrounded by an outer housing, the two housings being spaced to provide an intermediate chamber functioning as a draft diverter.

A further object of the present invention is to provide a heat reclaimer combined with a draft diverter and a motorized valve, the valve serving to significantly retard gas flow through both the heat reclaimer and gas diverter when the heater is inoperative.

These and other objects and advantages of the present invention will become more apparent as the description proceeds with the aid of the accompanying drawings wherein.

Figure 1:
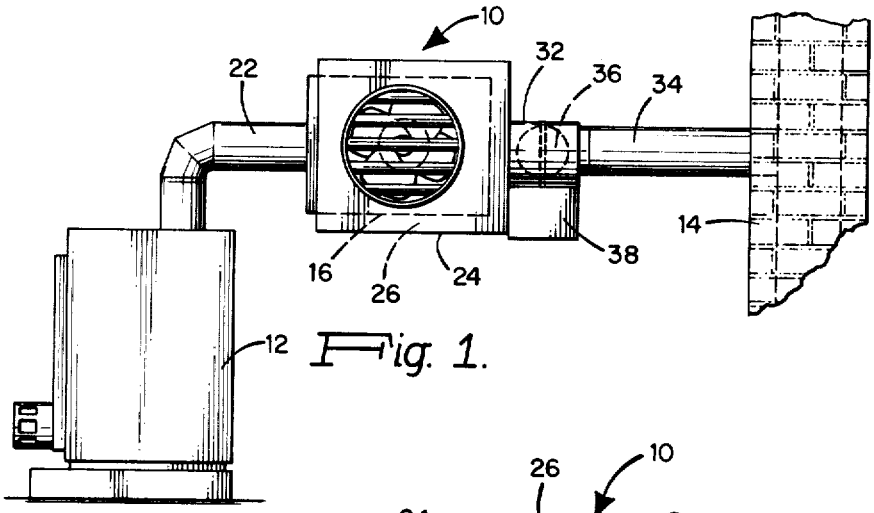
FIG. 1 is a schematic view of a heat reclaimer embodying the concepts of the present invention shown installed in a flue between a gas heater and an exhaust stack.
Figure 2:
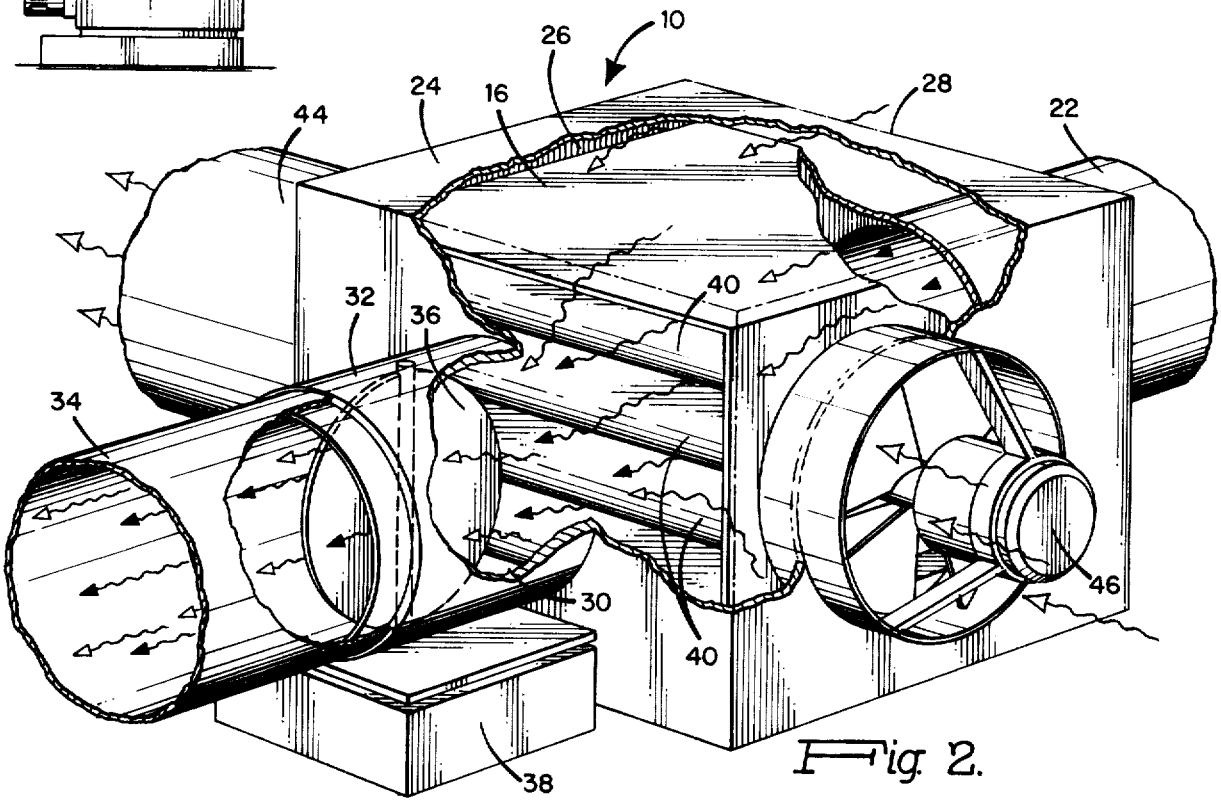
FIG. 2 is a perspective view with portions broken away of a heat reclaimer in accordance with the present invention.
Figure 3:
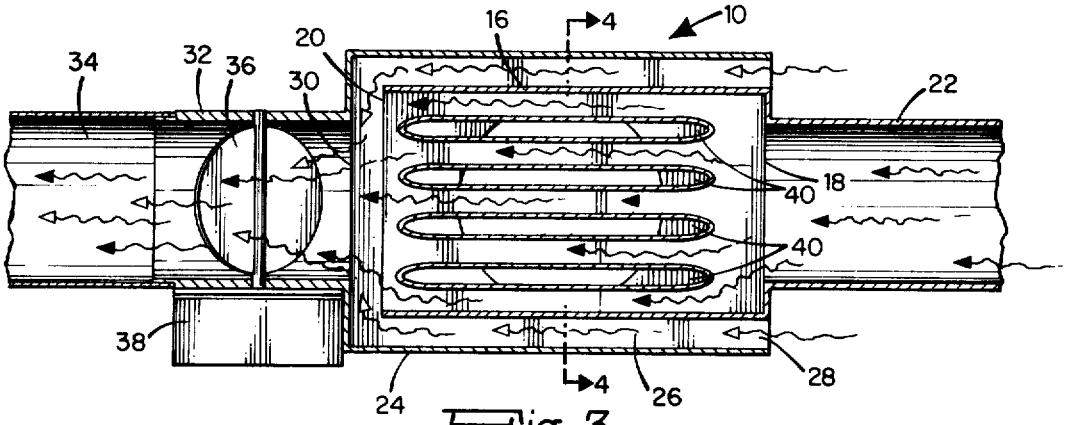
FIG. 3 is a longitudinal sectional view on a reduced scale taken through the heat reclaimer shown in FIG. 2; and, FIG. 4 is a sectional view taken along lines 4—4 of FIG. 3.
Figure 4:
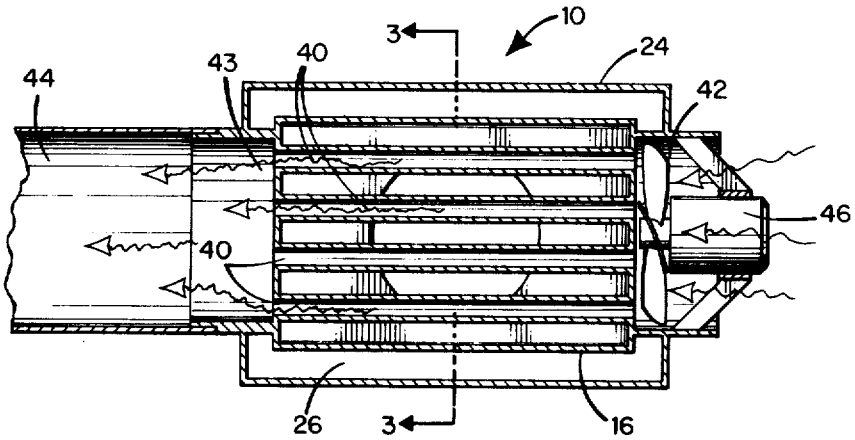

Referring initially to FIG. 1, a heat reclaiming apparatus in accordance with the present invention is generally indicated at 10 in an installed position between a heater 12 and an exhaust stack or chimney 14.

The heater 12 is illustrated as comprising a gas fired boiler or furnace of the type employed to heat a small building or dwelling. It will hereinafter be explained, however, that the invention is also applicable to or useful in conjunction with other types of heaters including those fired by oil.

Referring additionally to the other drawings, it will be seen that the apparatus 10 includes an inner housing 16 having first inlet and outlet openings 18 and 20. The first inlet opening 18 is adapted for connection to one section 22 of a flue leading from the heater 12. An outer housing 24 at least partially surrounds the inner housing 16. The inner and outer housings are spaced one from the other to define an intermediate chamber 26 therebetween. The first outlet opening 20 of the inner housing 16 is in communication with the intermediate chamber 26. The outer housing 24 is provided with second inlet and outlet openings 28, 30. The second inlet opening 28 is open to the ambient air and the second outlet opening 30 is located oppositely to the first outlet opening 20. The second outlet opening 30 leads to a damper housing 32 which preferably is fabricated as an integral unit with the outer housing 24. The damper housing 32 is in turn adapted for connection to another flue section 34 leading to the stack or chimney 14. The damper housing 32 contains a damper 36 which is adjustable rotatably between open and closed positions by means of a drive motor (not shown) contained in an associated motor and control box 38.

A plurality of heat transfer conduits indicated typically at 40 extend transversely across and are spaced one from the other within the inner housing 16. The conduits 40 are in communication at one end with an inlet plenum chamber 42 and at the opposite end with an outlet plenum chamber 43 adapted for connection to a conduit 44. A fan 46 is mounted in the inlet plenum chamber 42 for the purpose of drawing ambient air into and through the heat transfer conduits 40 in a direction transverse to the flow of combustion gases flowing through the inner housing 16 from the heater 12. It will thus be seen that the exterior surfaces of the heat transfer conduits 40 are heated by the combustion gases, and this heat is reclaimed by the ambient air flowing through the heat transfer conduits 40. The heated ambient air is then directed by conduit 44 to any suitable location. The damper 36 is adjustable between an open position allowing a mixture of combustion gases and entrained ambient air flowing respectively from the inner housing 16 and the intermediate chamber 26 to pass freely through the flue section 34 to the exhaust stack 14, and a closed position significantly retarding the flow of gases through both the inner housing and the intermediate chamber.

It will thus be seen that when the heater 12 is inoperative and the damper 36 is closed, heat will be retained in the heater 12 by virtue of the fact that gas flow therefrom is being significantly retarded. By the same token, little if any ambient air will be entrained into the intermediate chamber 26 and this will further conserve heat. Prior to allowing ignition to take place in the heater 12, the damper 36 is opened. Thereafter, as combustion takes place in the heater 12, the combustion gases will flow through the inner housing 16 where heat recovery will take place in the manner previously described. The exteriorily spaced outer housing 24 will provide a low temperature shield around the inner housing. The effects of any backdraft from the stack 14 experienced during operation of the heater 12 will be dissipated by the intermediate chamber 26 which acts as a draft diverter in addition to serving as a protective shield for the inner housing. The entire apparatus 10 provides a compact integral unit which can be installed conveniently between a heater 12 and a stack 14, even in relatively confined circumstances.

Where the draft diverter feature of the unit is not required, as is typically the case with oil fired heaters, then the second inlet opening 28 can be closed off. In this case, a conventional barometric damper would be installed at some point between the damper 36 and the heater, preferably in one side of the outer housing 24.

It is my intention to cover all changes and modifications of the embodiment herein chosen for purposes of disclosure which do not depart from the spirit and scope of the invention.

I claim:

1. Apparatus for reclaiming heat from and for controlling the flow of combustion gases passing through a flue from a heater to an exhaust stack, comprising: an inner housing having first inlet and outlet openings, said first inlet opening being adapted for connection to one section of said flue leading from said heater, whereby combustion gases from said heater will enter said inner housing through said first inlet opening and will exit from said inner housing through said first outlet opening; an outer housing at least partially surrounding said inner housing, said inner and outer housings being spaced one from the other to define an intermediate chamber therebetween which is in communication with said first outlet opening, a second outlet opening in said outer housing, said second outlet opening being in substantial alignment with said first outlet opening and being in communication with a damper housing which is in turn adapted for connection to another section of the flue leading to the exhaust stack; a plurality of conduit means spaced one from the other for directing a flow of ambient air through said inner housing, said conduit means having walls which receive heat from the combustion gases passing through said inner housing and which transfer said heat to said flow of ambient air; a second inlet opening in said outer housing, said second inlet opening being open to the ambient air; and a damper in said damper housing, said damper being adjustable between an open position allowing gases to flow through said damper housing and a closed position significantly retarding the flow of gases through said damper housing.

2. The apparatus as claimed in claim 1 wherein said conduit means are in communication at one end with an inlet plenum chamber and at the opposite end with an outlet plenum chamber, and fan means in said inlet plenum chamber for drawing ambient air into and through said conduit means.

3. The apparatus as claimed in claim 1 wherein said conduit means extend across said inner housing in a direction transverse to the flow of combustion gases therethrough.

4. The apparatus as claimed in claim 1 wherein said damper housing is fabricated as an integral unit with said outer housing.

* * * * *